324-77 SR
10/10/78 XR 4,119,070

United States Patent [19]

Asano

[11] 4,119,070

[45] Oct. 10, 1978

[54] CLOSED-LOOP MIXTURE CONTROL SYSTEM FOR AN INTERNAL COMBUSTION ENGINE WITH CIRCUITRY FOR TESTING THE FUNCTION OF CLOSED LOOP

[75] Inventor: Masaharu Asano, Yokohama, Japan

[73] Assignee: Nissan Motor Company, Ltd., Japan

[21] Appl. No.: 683,658

[22] Filed: May 6, 1976

[30] Foreign Application Priority Data

May 12, 1975 [JP] Japan ..... 50-54612
Jun. 20, 1975 [JP] Japan ..... 50-83651[U]

[51] Int. Cl.[2] ..... F02M 7/00

[52] U.S. Cl. ..... 123/119 EC; 73/119 A; 123/32 EK; 123/198 D; 235/302; 324/77 G; 324/78 D; 364/579

[58] Field of Search ..... 123/32 EE, 119 EC, 198 D, 123/32 EK; 60/276, 285; 324/78 D, 78 Z, 77 G; 73/119 A; 235/181, 151.3; 364/431

[56] References Cited

U.S. PATENT DOCUMENTS

| | | | |
|---|---|---|---|
| 3,463,911 | 8/1969 | Dupraz et al. | 235/181 |
| 3,670,151 | 6/1972 | Lindsay et al. | 235/181 |
| 3,718,813 | 2/1973 | Williams, Jr. et al. | 324/77 G |
| 3,760,355 | 9/1973 | Bruckert | 235/181 |
| 3,890,946 | 6/1975 | Wahl | 123/32 EE |
| 3,900,012 | 8/1975 | Wahl et al. | 123/32 EE |
| 3,919,885 | 11/1975 | Kaireit | 73/119 A |
| 3,938,075 | 2/1976 | Reddy | 60/285 |
| 3,948,228 | 4/1976 | Luchaco | 123/32 EE |

*Primary Examiner*—Charles J. Myhre
*Assistant Examiner*—Andrew M. Dolinar
*Attorney, Agent, or Firm*—Robert E. Burns; Emmanuel J. Lobato; Bruce L. Adams

[57] ABSTRACT

A closed-loop mixture control system for an internal combustion engine comprises an electronic control section and an electromechanical section comprised of the engine, an air-fuel metering system and an exhaust composition sensor. The system further comprises a first diagnosis circuit for testing the electromechanical section by application of a recurrent series of binary signals to the metering system, and second and third diagnosis for circuits for testing the function of the electronic control section by application of staircase waveform signal or a train of variable width pulses selectively to the input of the control section. The applied test signals are received by the respective diagnosis circuits to check the performance of the control loop.

8 Claims, 7 Drawing Figures

CLOSED-LOOP MIXTURE CONTROL SYSTEM FOR AN INTERNAL COMBUSTION ENGINE WITH CIRCUITRY FOR TESTING THE FUNCTION OF CLOSED LOOP

BACKGROUND OF THE INVENTION

The present invention relates generally to mixture control systems for an internal combustion engine, and in particular to a closed-loop mixture control system using diagnosis circuits for testing the functions of the control loop.

In a closed-loop mixture control system, an exhaust composition sensor is provided to supply information on the air-fuel ratio of the mixture and feeds its information to a control circuit having proportional and integral control response characteristics to generate a signal that varies the fuel quantity such that the air-fuel ratio is controlled at a desired value.

SUMMARY OF THE INVENTION

Therefore, an object of the invention is to provide a closed-loop mixture control system in which diagnostic facilities are provided to check for malfunction arising during enging operation to thereby prevent emission of noxious exhaust gases for extended periods of time.

According to the present invention, there is provided a closed-loop mixture control system for an internal combustion engine, which comprises an exhaust composition sensor for generating a first signal representing a composition of the exhaust emission from said engine, a comparator operable to compare the first signal with a reference level to generate a second signal indicating whether the air-fuel ratio of the mixture is above or below a predetermined value, a control circuit for amplifying the second signal in accordance with a predetermined response characteristic, means for supplying the mixture to the engine in accordance with the signal from the control circuit, means for applying a test signal of a predetermined waveform to a portion of the closed loop constituted by the engine, the exhaust composition sensor, the control circuit and the mixture supplying means to produce fluctuations, and means arranged to be connected to another portion of the closed loop to determine whether the fluctuations conform to the predetermined waveform.

The closed-loop mixture control system generally comprises an electronic control section and an electromechanical section including an air-fuel metering system, an engine and an exhaust composition sensor. A first diagnosis circuit generates a recurrent series of binary signals which occur in a predetermined order and applies the binary test signals to the metering system to vary the air-fuel ratio, and receives a signal from the exhaust composition sensor to check it against a signal format stored in a memory device to determined the degree of similarity therebetween. When the similarity is greater than a predetermined degree, the electromechanical section of the closed-loop is judged as working properly, and the results of the test are visually indicated.

The electronic control section is an amplifier having a proportional and an integral response characteristic A second diagnosis circuit generates a staircase wave signal and applies it to the amplifier to test its proportional response characteristic and receives a signal from the output of the control amplifier to check if the output is an exact replica of the input test signal by counting the number of steps in the output signal. A third diagnosis circuit generates a train of variable width pulses and applies the pulse train to the input of the control amplifier to diagnose the integral response characteristic of the amplifier, and receives a signal from the output of the control amplifier to determine whether the output is caused to vary between preset voltage levels in response to the varying width of the input signal.

BRIEF DESCRIPTION OF THE DRAWINGS

The invention will be further described with reference to the accompanying drawings, in which.

DESCRIPTION OF THE PREFERRED EMBODIMENTS

Figure 1:
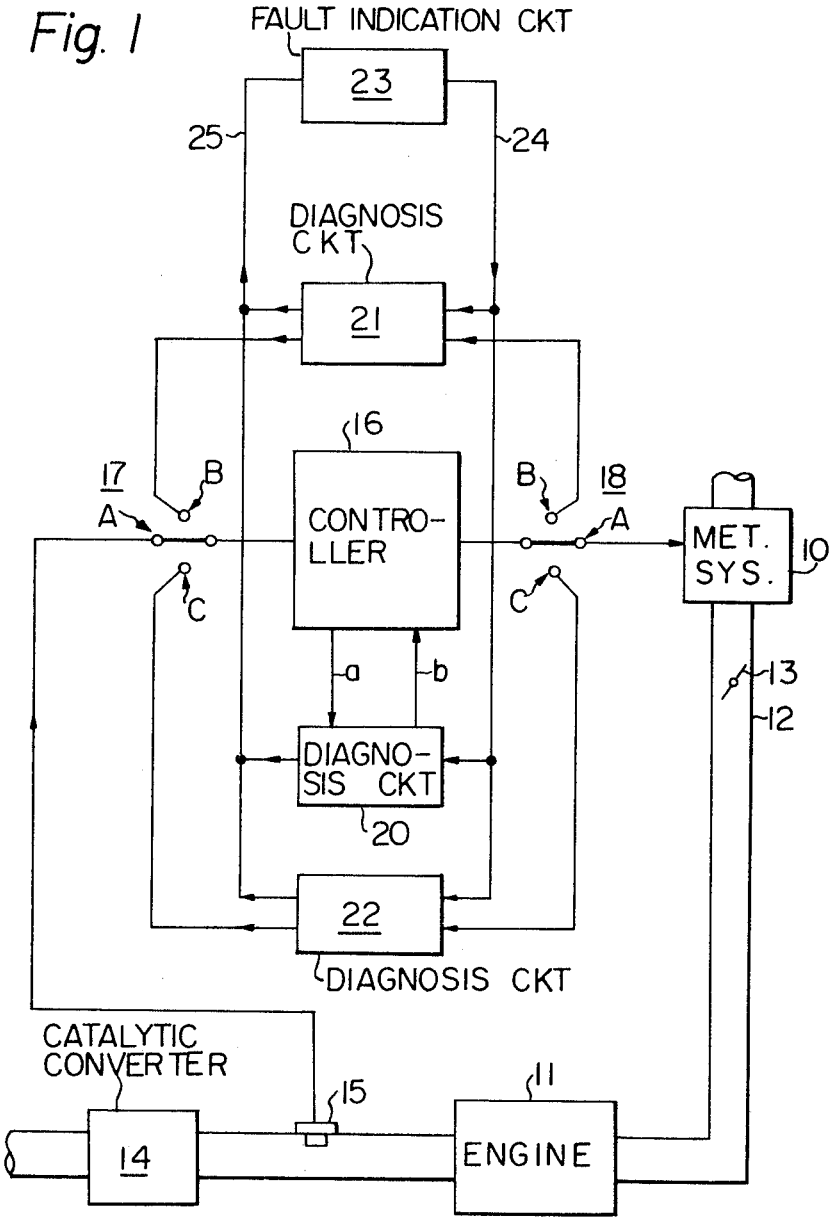
FIG. 1 is a general circuit block diagram of the invention.

Referring now to FIG. 1, there is shown a general circuit diagram of the closed-loop mixture control system of the invention. A fuel metering system 10 such as a pulse-operated carburetor or an electronic fuel injector supplies air-fuel mixture to the cylinders of an internal combustion engine 11 through inlet pipe 12 in which a throttle valve 13 is disposed in conventional manner. A catalytic converter 14 of a three-way catalyst type, for example, is provided at the exhaust side of the engine to convert the exhaust emission to harmless water vapor and carbon dioxide. The three-way catalytic converter is designed to operate at the maximum conversion efficiency when the air-fuel ratio is controlled at the stoichiometric value. The system includes an exhaust composition sensor 15 disposed in the exhaust pipe on the upstream side of the catalytic converter 14. This sensor may be a conventionally available zirconium dioxide oxygen sensor which extends into the passage of exhaust gases to provide an output whose amplitude varies as a function of the air-fuel ratio with a steep transition of at the stoichiometric point. The signal from the oxygen sensor 15 is fed into a controller 16 through contact A of a switch 17. As will be described hereinbelow, the controller 16 has proportional and integral response characteristics with which the sensor output is amplified and applied to the metering system 10 through contact A of a switch 18. Therefore, the system normally operates through the feedback control loop which is comprised of an electronic section (controller 16) and an electromechanical section including the metering system 10, engine 11 and exhaust composition sensor 15.

The system further includes diagnosis circuits 20, 21 and 22, which independently apply test signals to the control loop. The diagnosis circuit 20 is connected to the input and output stages of the controller 16 to apply a test signal through the output stage of the controller to the metering system 10 and receive the output from the exhaust sensor 15 through the controller input stage to primarily verify the function of the electromechanical section of the system. The second diagnosis circuit 21 is connected to the input and output circuits of the controller 16 through contacts B of switches 17 and 18 to diagnose the proportional response characteristic of the controller, while the third diagnosis circuit 22 is connected to the input and output circuits of the controller through contacts C of switches 17 and 18 to test the integral response characteristic of the controller. A fault indication circuit 23 is connected to the input and output circuits of the diagnosis circuits 20, 21, 22 to initiate the respective tests through enable lead 24 and indicate the results of the tests provided on lead 25.

Figure 2:
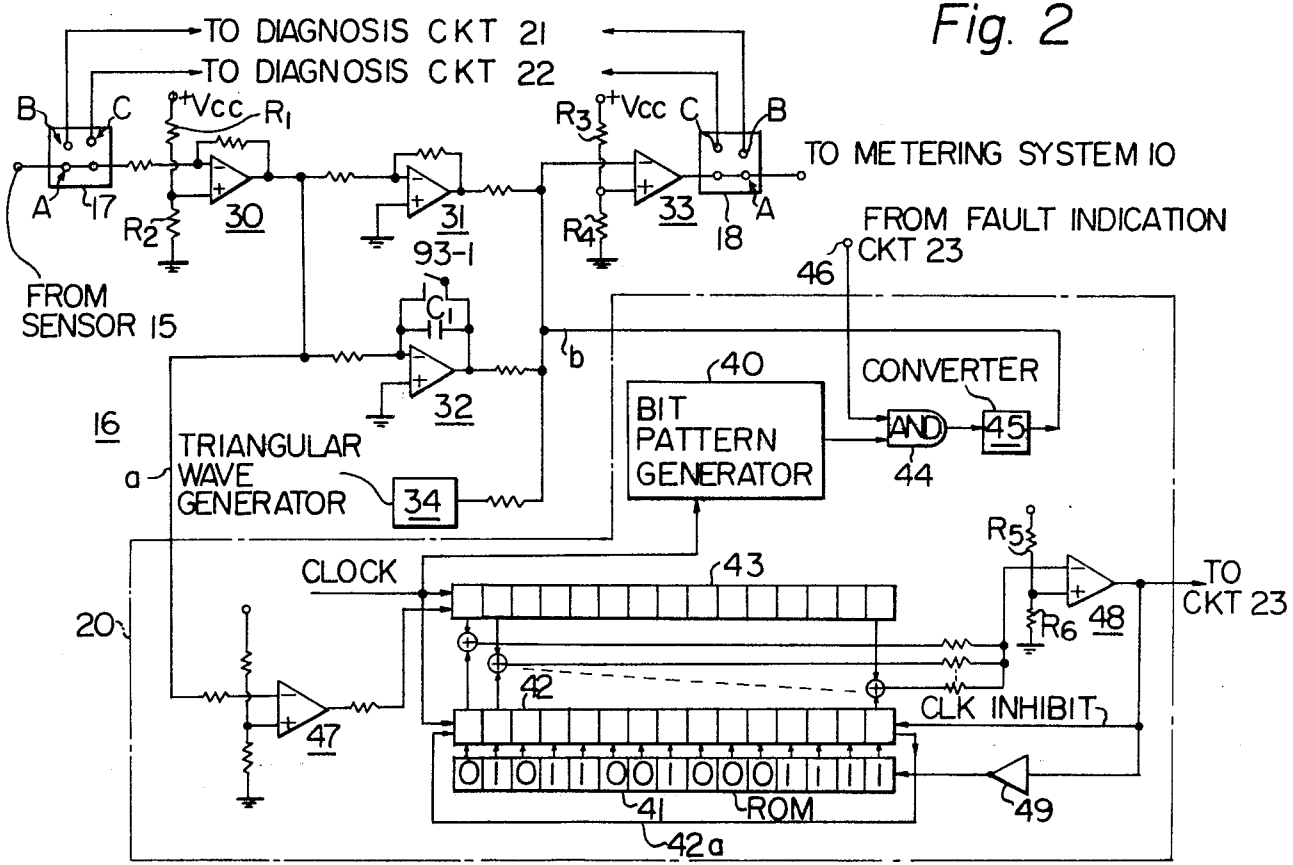
FIG. 2 is a detailed circuit of a diagnosis circuit for testing the electromechanical section of a closed-loop mixture control system.

As illustrated in FIG. 2, the controller 16 comprises a differential amplifier 30 which receives the output from the sensor 15 on its inverting input for comparison with a reference voltage from a voltage divider circuit $R_1$, $R_2$. The output from the comparator 30 is positive when the sensor voltage is low when mixture is leaner than stoichiometry and negative when the sensor voltage is high when mixture is richer than stoichiometry. The comparator 30 output is connected to a proportional controller 31 and to an integral controller 32. The proportional controller 31 amplifies the input signal by a constant factor in a direction opposite to the sign of the comparator output, while integral controller 32 delivers an output which is an integration of the input signal with a polarity opposite to the sign of the comparator output. The output circuits of the proportional and integral controllers 31, 32 are connected to the inverting input of a summation operational amplifier 33. A triangular wave generator 34 feeds triangular wave pulses to the inverting input of operational amplifier 33. The combined input voltages are compared with a reference voltage from a voltage divider $R_3$, $R_4$ so that the output from the summation amplifier 33 is at one of high and low binary levels depending on whether the signal at the inverting input is above or below thr reference voltage and the width of the output pulse depends on the combined outputs from the proportional and integral controllers 31, 32.

The diagnosis circuit 20 shown in chain-dotted lines comprises a bit pattern generator 40 generating a train of binary pulses which occur in accordance with a particular recycling bit pattern (known as maximallength sequences), a read-only memory 41 having the capacity of, for example, 15 bits arranged in the same pattern as the bit pattern generated in the bit pattern generator 40, a shift register 42 connected in parallel to the read-only memory 41, and a shift register 43 having the same number of bit positions as the bit positions of the shift register 42. The output from the generator 40 is fed to an input of an AND gate 44 and thence to a converter 45 which converts the unipolar signal from the generator 40 into a bipolar signal. The bipolar test signal is applied to the inverting input of summation amplifier 33 when the AND gate 44 is enabled by a signal from the fault indication circuit 23 through terminal 46.

Figure 5:
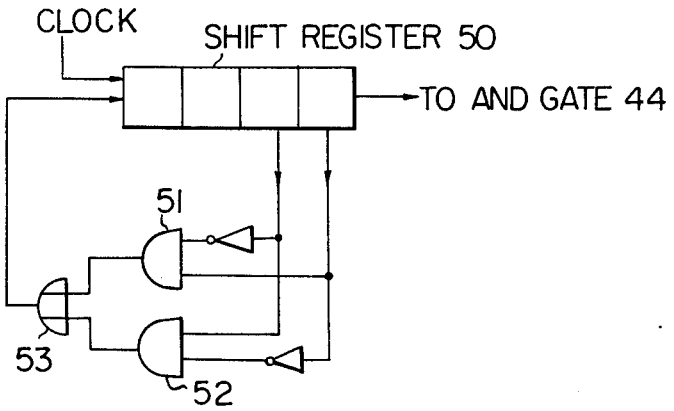
FIG. 5 is a schematic of a pulse generator used in the circuit of FIG. 2 to generate a recurrent series of binary test signals.

As illustrated in FIG. 5, the bit pattern generator 40 comprises a four-bit shift register 50 and a logic circuit comprising two AND gates 51, 52 having their inputs connected to two of the rightmost bit positions of the shift register through inverters as illustrated and an OR gate 53 connected between the output of AND gates 51, 52 and the data input of the shift register 50. By examination of the circuit of FIG. 5, it will be observed that a "1" logic input is clocked into the shift register 50 from OR gate 53 only when the binary states of the two rightmost bit positions are either "01" or "10." The output is a recurrent series of 15 bits "111100010011010." This binary signal is converted into a bipolar signal of an amplitude much greater than the maximum amplitude of the combined outputs from the controllers 31, 32 and the triangular wave generator 34. The bipolar signal is applied to the inverting input of the summation amplifier 33 to drive it to saturation so that the output from the summation circuit 33 is an amplification of the bipolar signal. The metering system 10 is driven by the bipolar test signal so that air-fuel mixtures are controlled in accordance therewith.

Variations of air-fuel mixture will be observed by the oxygen sensor 15 after combustion. As a result, the output voltage of the comparator 30 of controller 16 is caused to vary in accordance with the sensor output and inverted by an operational amplifier 47 of diagnosis circuit 20 and applied to the data input of shift register 43. The read-only memory 41 is loaded with the same bit series generated from the bit pattern generator 40. If the electromechanical section of the control loop is properly functioning, the signals clocked into the shift register 43 will be identical to those stored in the memory 41, which have been transferred to the shift register 42 in parallel form. A plurality of Exclusive-OR gates designated by a symbol "+" is connected between the shift register 43 and ring counter 42 for bit-for-bit comparison. The outputs from the Exclusive-OR gates are connected to the inverting input of an operational amplifier 48 for comparison with a reference voltage from a voltage divider $R_5$, $R_6$.

When coincidence occurs between the shift registers 43 and 42, each Exclusive-OR produces a low level signal. If the contents of the shift registers 43 and 42 exceed a predetermined degree of similarity, the voltage at the inverting input of amplifier 48 will fall below the reference voltage at the noninverting input to switch the amplifier 48 to the high-output state. This high voltage output is inverted by an inverter 49 to disable the connections between read-only memory 41 and shift register 42, and at the same time, applied to shift register 42 to cause it to recirculate its stored bits through lead **42*a* by the clock signal in step with the signals in shift register 43. This condition will exist as long as the AND gate 44 is enabled provided that the electromechanical section of the control loop is properly functioning, and the output from operational amplifier 48 remains high and is applied to the fault indication circuit 23** to light up the green lamp.

The test described above is initiated by a nonlocking manual switch 60 (FIG. 4) which , when closed, applies a start signal to a one-shot multivibrator 61 which feeds a test pulse to the diagnosis circuit 20, and also to a delay circuit 62. In the presence of the test pulse both shift register 43 and ring counter 42 are shifted by the clock pulse provided that the tested feedback loop is properly functioning so that the output of amplifier 48 remains high. This high output is connected to one input of an AND gate 63 and to the inverting input of an AND gate 64. The output from the delay circuit 62 is fed into the other inputs of AND gates 63. 64. The test pulse from the one-shot multivibrator 61 is delayed for an interval longer than the maximum transport delay time of the engine 11. If the control loop under test is working properly, the output from the test circuit 20 will appear before a signal appears at the output of delay circuit 62. In this case, AND gate 63 will be enabled and the delayed pulse will be passed through the enabled gate to cause a flip-flop 65 to go into the high-output state. This high output is passed through an AND gate 67 to light up a green lamp, while inhibiting an AND gate 68. Conversely, if no signal is delivered from the test circuit 20 within a predetermined period, AND gate 64 will be activated upon the occurrence of the delayed signal, and flip-flop 66 is turned on to light up a red lamp through AND gate 68. These lamps are extinguished by a reset switch 69 connected to the reset terminals of flip-flops 65, 66.

Figure 3:
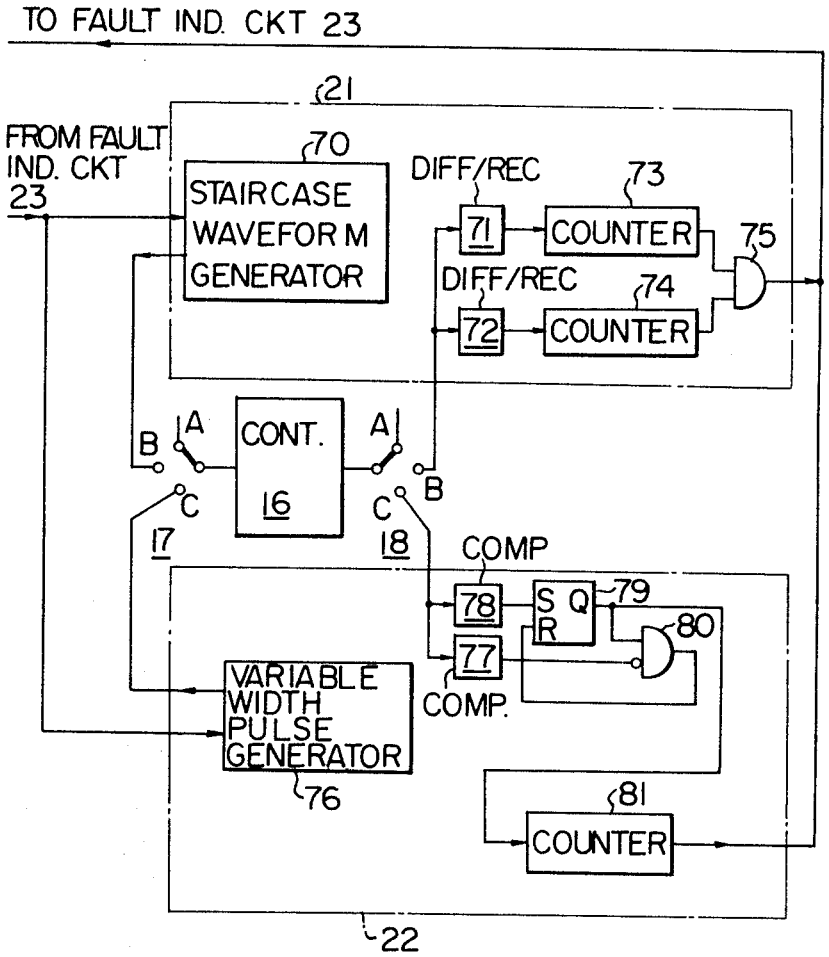
FIG. 3 is a circuit block diagram of diagnosis circuits for testing the proportional and integral response characteristics of the electronic controller of the closed-loop mixture control system.
Figure 6:
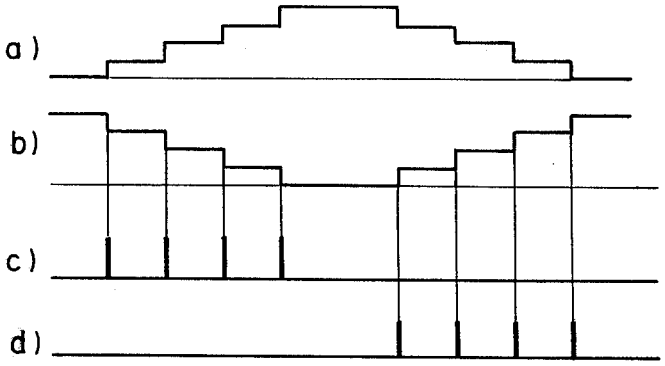
FIGS. 6 and 7 are waveform diagrams generated in the circuit of FIG. 3 for the diagnosis of proportional and integral response characteristics, respectively, of the electronic controller.

FIG. 3 shows the detail of diagnosis circuits 21 and 22. The circuit 21 comprises a staircase waveform generator 70 connected to the input of controller 16 through the B contact of switch 17, first and second differentiator/rectifiers 71 and 72 connected to the output of controller 16 through the B contact of switch 18, and first and second counters 73 and 74 connected to the outputs of the differentiator/rectifiers 71 and 72, respectively. The generator 70 produces a staircase waveform which rises and falls at equal number of steps as illustrated in FIG. 6*a*. If the proportional operational amplifier 31 of controller 16 is properly functioning, the output of the controller varies in amplitude exactly in step with the change in the input voltage, but in opposite direction to the sign of the input signal (FIG. 6*b*). This output waveform is differentiated by the differentiators 71 and 72 so that the former provides differentiated pulses at the falling edges of the input signal, while the latter generates differentiated pulses at the rising edges as shown in FIGS. 6*c* and 6*d*. The signals from both differentiators are counted by counters 73 and 74 each of which provides an output when a predetermined number of counts is reached. If the output from the controller 16 is exactly proportional (regardless of the integral response) to the input signal, the same number of counts will be reached in both counters and outputs produced from the counters. An AND gate 75 is connected to the outputs of counters 73, 74 to generate a coincidence output and applies it to the fault indication circuit 23.

Figure 4:
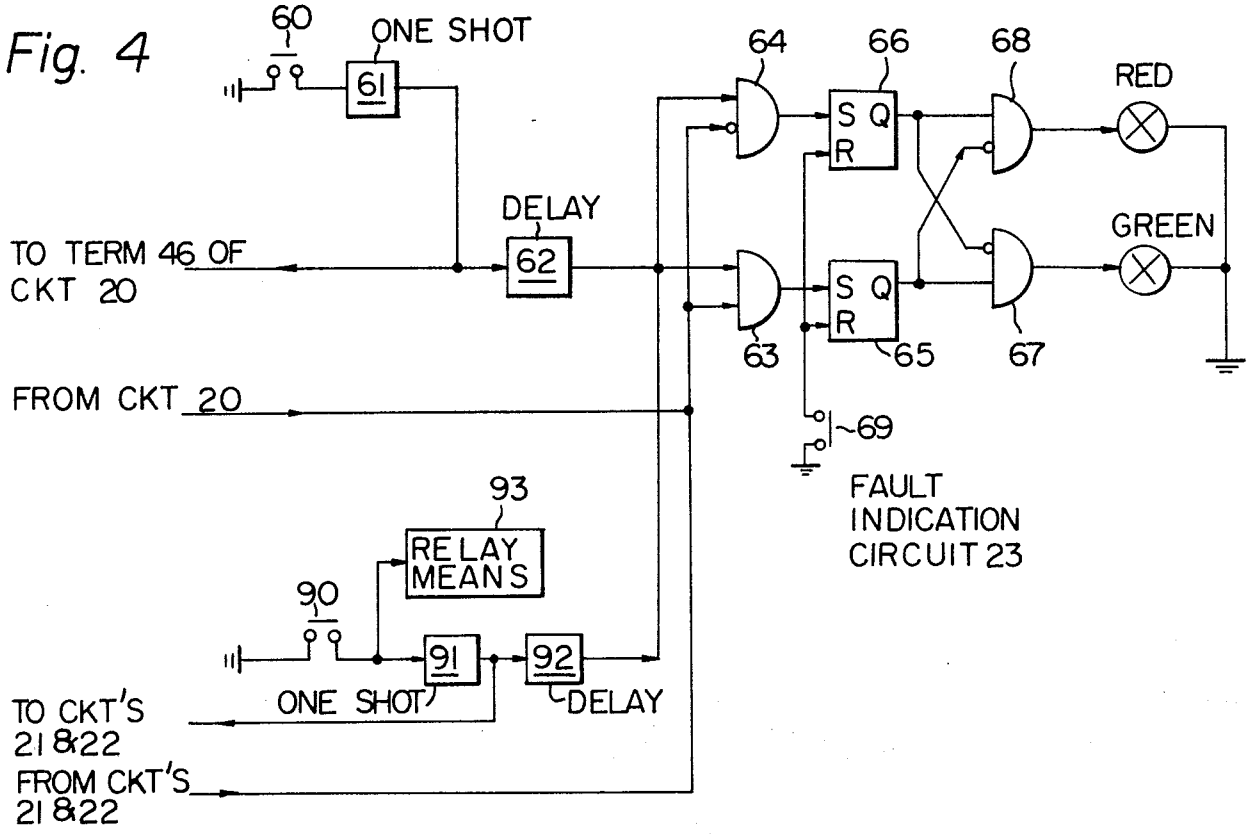
FIG. 4 is a circuit diagram of a fault indication circuit.

In FIG. 4, the fault indication circuit 23 further includes a manual switch 90 of a non-locking type, a one-shot multivibrator 91 and a delay circuit 92 all of which are connected in series between one input of AND gates 63, 64 and ground. The test signal applied to the controller 16 is generated when the manual switch 90 is operated activating the one-shot multivibrator 91. The output pulse from 91 is applied as the enable signal to the staircase generator 70 and at the same time applied to the delay circuit 92. The delayed pulse and the output from the AND gate 75 of test circuit 21 are applied to AND gates 63, 64 of the fault indication circuit 23. As previously described, AND gate 63 will be enabled to pass the delayed signal from circuit 92 to switch the flip-flop 65 to go into the high-output state to light up the green lamp if the proportional response characteristic of the controller 16 is working properly, and if no output is delivered within a predetermined period from the test circuit 21, AND gate 64 will be activated upon the occurrence of the delayed pulse to light up the red lamp indicating faulty proportional response characteristic.

Figure 7:
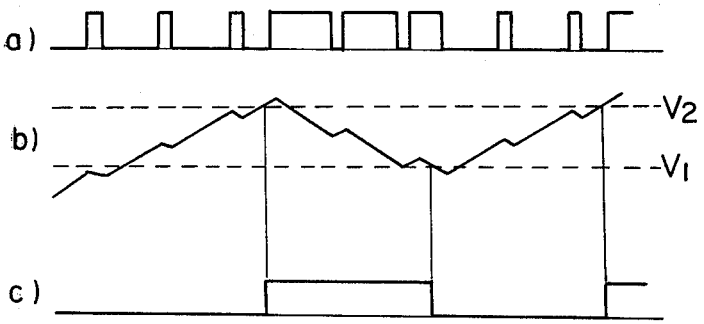

The integral response characteristic of the controller 16 is tested by first operating the manual control switch 90 of circuit 23 with the switches 17 and 18 being positioned at "C." The integral response test circuit 22 comprises a variable width pulse generator 76 connected to the input of controller 16 through the C contact of switch 17, a level detector having a hysteresis characteristic formed by first and second comparators 77, 78, a flip-flop 79 and an AND gate 80. The inputs of both comparators 77, 78 are connected to the output of controller 16 through the C contact of switch 18 to provide outputs at different voltage levels. The pulse generator 76 produces a train of pulses whose width varies periodically as illustrated in FIG. 7*a*. If the integral operational amplifier 32 of controller 16 is properly functioning, the output from the controller 16 decreases in amplitude in the presence of greater width pulses and increases in the presence of smaller width pulses as illustrated in FIG. 7*b* so that the output voltage fluctuates between different voltage levels. When the output exceeds the voltage level $V_2$ the comparator 78 provides an output which switches flip-flop 79 to go into the high-output state. This high output is also fed into one input of AND gate 80. As the voltage falls below the level $V_1$ the comparator 77 switches into the low-output state. The low condition of comparator 77 enables the AND gate 80 to place a "1" output to the reset terminal of flip-flop 79 so that the Q output goes low as clearly shown in FIG. 7*c*. Therefore, a single pulse is delivered from the flip-flop 79 in response to the variation of the width of the test pulse. A counter 81 may be provided to count the output pulses from the flip-flop 79 to provide an output when a predetermined count is reached. The counter 81 output is connected to the fault indication circuit 23 to indicate the validity of the integral response characteristic of the controller 16 in the same manner as described in connection with the proportional control diagnosis. A relay 93 is connected to the manual switch 90. This relay has its normally open contact 93-1 connected across the integrating capacitor $C_1$ of the integral operational amplifier 32, so that upon the operation of switch 90, the capacitor C is discharged to reset the integrator 32 prior to the application of the test signal to the controller 16, thus assuring it to vary its output voltage between the predetermined voltage levels if it is properly functioning.

What is claimed is:

1. A closed-loop mixture control system for an internal combustion engine, comprising an exhaust composition sensor for in use generating a first signal representing and corresponding to the concentration of a composition of the exhaust emissions from an internal combustion engine, a first comparator to compare the first signal with a reference level to generate a second signal indicating whether the air-fuel ratio of the mixture in said engine is above or below a predetermined value, a control circuit for generating a third signal representing and corresponding to an amplification of the second signal in accordance with a predetermined response characteristic, means for supplying the mixture to said engine in accordance with the third signal, means for generating a recurrent series of binary signals occurring in accordance with a predetermined bit pattern for application to said mixture supplying means instead of the signal from said control circuit to thereby produce artificial fluctuations of the air-fuel ratio, means for storing said bit pattern in a serial form, a first shift register receptive of said first signal resulting from said artificial fluctuations of the air-fuel ratio, a second shift register receptive of said stored bit pattern and effective to shift the received bit pattern in synchronism with said first shift register, a plurality of exclusive-OR gates connected between said first and second shift registers, and a second comparator for comparing a sum of the outputs from said exclusive-OR gates with a fixed reference to generate an output when the degree of similarity between the stored bits of said first and second shift registers exceeds a predetermined level.

2. A closed-loop mixture control system as claimed in claim 1, further comprising means connected to the output of said second comparator for indicating the result of the comparison.

3. A closed-loop mixture control system as claimed in claim 1, further comprising a recirculating path connected between the input and output of said second shift register for recirculating the binary bits stored therein therethrough.

4. A closed-loop mixture control system for an internal combustion engine, comprising an exhaust composition sensor for in use generating a first signal representing and corresponding to the concentration of a composition of the exhaust emissions from an internal combustion engine, a comparator to compare the first signal with a fixed reference to generate a second signal indicating whether the air-fuel ratio of the mixture is above or below a predetermined value, a control circuit having a proportional control response characteristic for generating a third signal representative of a proportional amplification of said second signal, means for supplying the mixture to said engine in accordance with said third signal, means for generating a staircase waveform signal having a predetermined number of step changes for application to the input of said control circuit to thereby vary said third signal in accordance with the step changes, and counting means connected in operation to the output of said control circuit for counting the resultant step changes, and means for determining whether the number of counted step changes corresponds to the number of step changes of the staircase waveform signal applied to the input of said control circuit.

5. A closed-loop mixture control system as claimed in claim 4, wherein said staircase waveform signal has an equal number of rising and falling step changes, and wherein said counting means comprises a first set of a differentiator for producing a series of pulses by differentiation of the rising step changes and a counter for counting the pulses and a second set of a differentiator for producing a series of pulses by differentiation of the falling step changes and a counter for counting the last-mentioned pulses, each of said counters producing an output upon the counting of a number equal to the number of either rising or falling step changes of the waveform signal applied to the control circuit when said controller is operating properly, and discriminating gating means connected to the outputs of said counters for producing a gated output when the signals applied thereto occur simultaneously at its inputs.

6. A closed-loop mixture control system for an internal combustion engine, comprising an exhaust composition sensor for in use generating a first signal representing and corresponding to the concentration of a composition of the exhaust emissions from an internal combustion engine, a comparator operable to compare the first signal with a fixed reference to generate a second signal indicating whether the air-fuel ratio of the mixture is above or below a predetermined value, a control circuit having an integral control characteristic for generating a third signal representative of an integration of said second signal, means for supplying the mixture to said engine in accordance with said third signal, means for generating a series of variable width pulses for application to the input of said control circuit to thereby vary the third signal in accordance with the width of the generated signal, and means connected in operation to the output of said control circuit for detecting whether the magnitude of the resultant third signal varies in accordance with the width of said variable width pulses applied to the input of said control unit.

7. A closed-loop mixture control system as claimed in claim 6, wherein said magnitude detecting means comprises a first detector to determine whether the signal applied thereto increases to a first predetermined level and a second detector to determine whether the applied signal decreases to a second predetermined level.

8. A closed-loop mixture control system as claimed in claim 7, further comprising means for converting the signal detected by the first and second detectors into a binary signal and means for counting the binary signal to provide an output when a predetermined number is reached.

* * * * *